US009932174B2

(12) United States Patent
Han

(10) Patent No.: US 9,932,174 B2
(45) Date of Patent: Apr. 3, 2018

(54) PEDAL WASTE BIN OPTIMIZED FOR PARTIAL OR FULL FACTORY AUTOMATION

(71) Applicant: BARENTHAL NORTH AMERICA, INC., Whippany, NJ (US)

(72) Inventor: Hongyuan Han, New Vernon, NJ (US)

(73) Assignee: Barenthal North America, Inc., Whippany, NJ (US)

( * ) Notice: Subject to any disclaimer, the term of this patent is extended or adjusted under 35 U.S.C. 154(b) by 215 days.

(21) Appl. No.: 14/919,866

(22) Filed: Oct. 22, 2015

(65) Prior Publication Data

US 2017/0113873 A1 Apr. 27, 2017

(51) Int. Cl.

| | |
|---|---|
| ***B65D 43/26*** | (2006.01) |
| ***B65F 1/16*** | (2006.01) |
| ***B65F 1/02*** | (2006.01) |
| ***B65F 1/08*** | (2006.01) |

(52) U.S. Cl.

CPC ..... *B65F 1/163* (2013.01); *B65F 1/02* (2013.01); *B65F 1/08* (2013.01); *B65F 1/1646* (2013.01); *B65D 43/26* (2013.01); *B65D 43/262* (2013.01); *B65D 43/265* (2013.01); *B65F 2001/1661* (2013.01); *B65F 2001/1676* (2013.01); *B65F 2250/112* (2013.01); *B65F 2250/1143* (2013.01)

(58) Field of Classification Search

CPC .... B65F 1/163; B65F 1/02; B65F 1/08; B65F 1/1646; B65F 2001/1661; B65F 2001/1676; B65F 2250/112; B65F 2250/1143; B65D 43/26; B65D 43/262; B65D 43/265

USPC ..... 220/23.87, 263, 264, 262, 495.01, 828, 220/908, 908.1

See application file for complete search history.

(56) References Cited

U.S. PATENT DOCUMENTS

| | | | | |
|---|---|---|---|---|
| 6,010,024 A * | 1/2000 | Wang | B65F 1/163 | 220/23.87 |
| 2006/0278643 A1* | 12/2006 | Chiou | B65F 1/06 | 220/263 |
| 2008/0023474 A1* | 1/2008 | Yang | B65F 1/068 | 220/23.87 |

* cited by examiner

*Primary Examiner* — J. Gregory Pickett
*Assistant Examiner* — Elizabeth Volz
(74) *Attorney, Agent, or Firm* — Preti Flaherty Beliveau & Pachios LLP

(57) ABSTRACT

A trash bin having parts optimized for partial or full automated assembly. Components are fabricated of materials that are easily manipulated by factory automation equipment as well as those that may be selectively deformed during the assembly or installation process. Elastic or deformable characteristics also facilitate the retention of assembled or installed parts. A barbed element deforms during installation into a received aperture, then returns to a relaxed state in which one or more barbs inhibit the dislocation of the element from the aperture. A post having an aperture for receiving an axle therein is formed of resilient materials such that the post flexes outward under the urging of the axle until the axle is aligned with the aperture, at which point the post resumes a neutral position with the axle engaged in the aperture. Interfaces between components are selected in order to simplify the mechanical mating of components.

13 Claims, 7 Drawing Sheets

PEDAL WASTE BIN OPTIMIZED FOR PARTIAL OR FULL FACTORY AUTOMATION

STATEMENT REGARDING FEDERALLY SPONSORED RESEARCH OR DEVELOPMENT n/a

BACKGROUND OF THE INVENTION

Traditional assembly methods for mechanically operative home goods, such as waste bins with mechanically operating lids, have typically involved a significant degree of manual intervention. This includes parts picking and transportation within a factory workspace, mating actuation mechanisms to substrates, and packaging finished products.

During the 1970's and 1980's, when U.S. automobile manufacturers were not producing vehicles of consistently high quality, it was said that a consumer should avoid buying a car that was made on a Monday or Friday. Cars made on Mondays were said to be assembled by hungover workers, and those made on Fridays were said to be assembled by workers already concentrating on the coming weekend. Whether there was any legitimacy to that warning, it does reflect the reality that assembly by humans is inherently variable, particularly assembly line work. While repeated motions, such as inserting tab A into slot B, may lead to efficiency of motion, it can also lead to boredom, inattention, and repetitive motion injuries, all of which can vary the quality of the work performed by the worker.

On the other hand, a properly programmed factory automation robot suffers none of the same drawbacks and instead performs the programmed tasks the same way, every time. Sensors can be employed to verify the proper functioning of the robot, and work can be ceased should a malfunction be detected, thus minimizing the risk that substandard work will be present in a finished product.

However, even with advanced automated assembly tools and techniques, not every product can be assembled without human intervention. For example, a waste bin with a pedal operated lid in the prior art has required a human operator to properly align and install the components of the lid actuation mechanism, including the Z-wire, lifting rod, mating elements, etc.

What is needed in the context of the manufacturing of home goods including waste bins is optimization for automated assembly.

BRIEF SUMMARY OF THE INVENTION

The presently disclosed invention includes a waste bin having parts optimized for partial or full automated assembly. Aspects of the invention include components fabricated of materials that are easily manipulated by factory automation equipment as well as those that may be selectively deformed during the assembly or installation process. Elastic or deformable characteristics also facilitate the retention of assembled or installed parts.

For example, a barbed element may deform during installation into a received aperture, then may return to a relaxed state in which one or more barbs inhibit the dislocation of the element from the aperture. In another example, a post having an aperture for receiving an axle therein may be formed of resilient materials whereby the post may flex outward under the urging of the axle until the axle is aligned with the aperture, at which point the post resumes it's neutral position with the axle engaged therein.

Interfaces between components are preferably selected in order to simplify the mechanical mating of components. Often, this results in one component being stationary on a first planar surface and a second component being brought into contact therewith in a direction orthogonal to the first component. In this manner, a maximum amount of vertical force can be applied to the mating of the components, an aspect helpful in overcoming resistance to deformation and/or friction.

Certain subcomponents are preferably provided pre-assembled to simplify the final assembly process.

BRIEF DESCRIPTION OF THE SEVERAL VIEWS OF THE DRAWINGS

Embodiments of the present invention may be better understood by referring to the following description in conjunction with the accompanying drawings in which.

DETAILED DESCRIPTION OF THE INVENTION

A trash bin comprised of components optimized for automatic or semi-automatic assembly is disclosed. While one particular configuration is shown, the illustrated and described novel aspects may be embodied in various configurations. Thus, while the trash bin as shown in FIG. 1 is oval, when viewed from above, it may alternatively be square, round, rectangular, etc.

Figure 1:
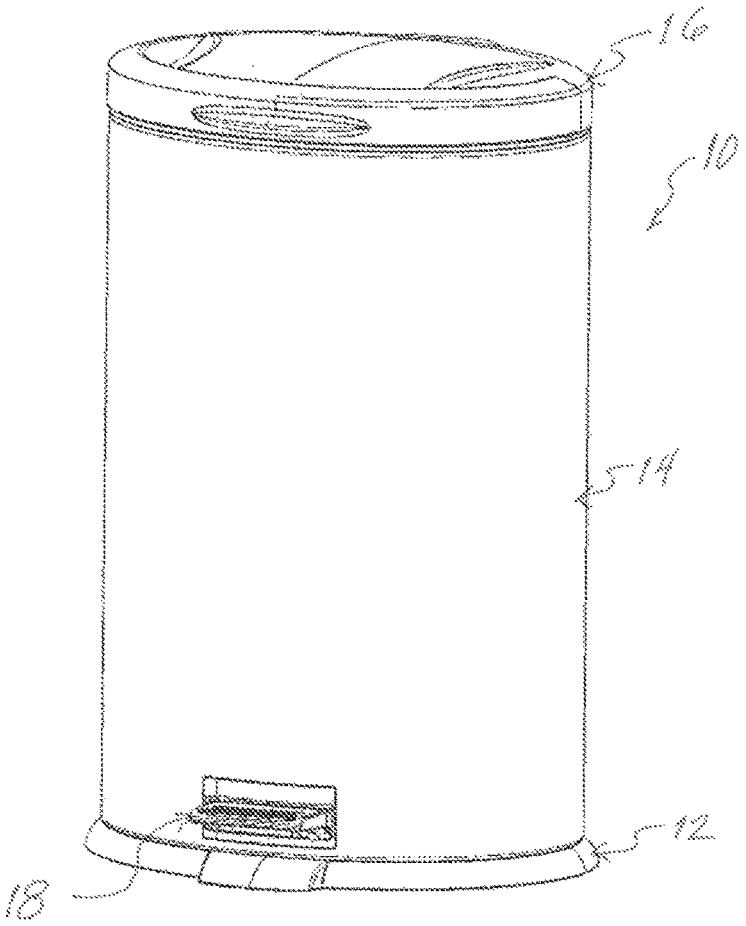
FIG. 1 is a perspective view of a first embodiment of a trash bin assembled according to automated methods, as disclosed herein.

Major portions of the trash bin 10 as shown in FIG. 1 include a base assembly 12, a side wall portion 14, and a lid assembly 16. A pedal assembly 18 is shown projecting from the side wall portion proximate the base assembly.

Figure 2:
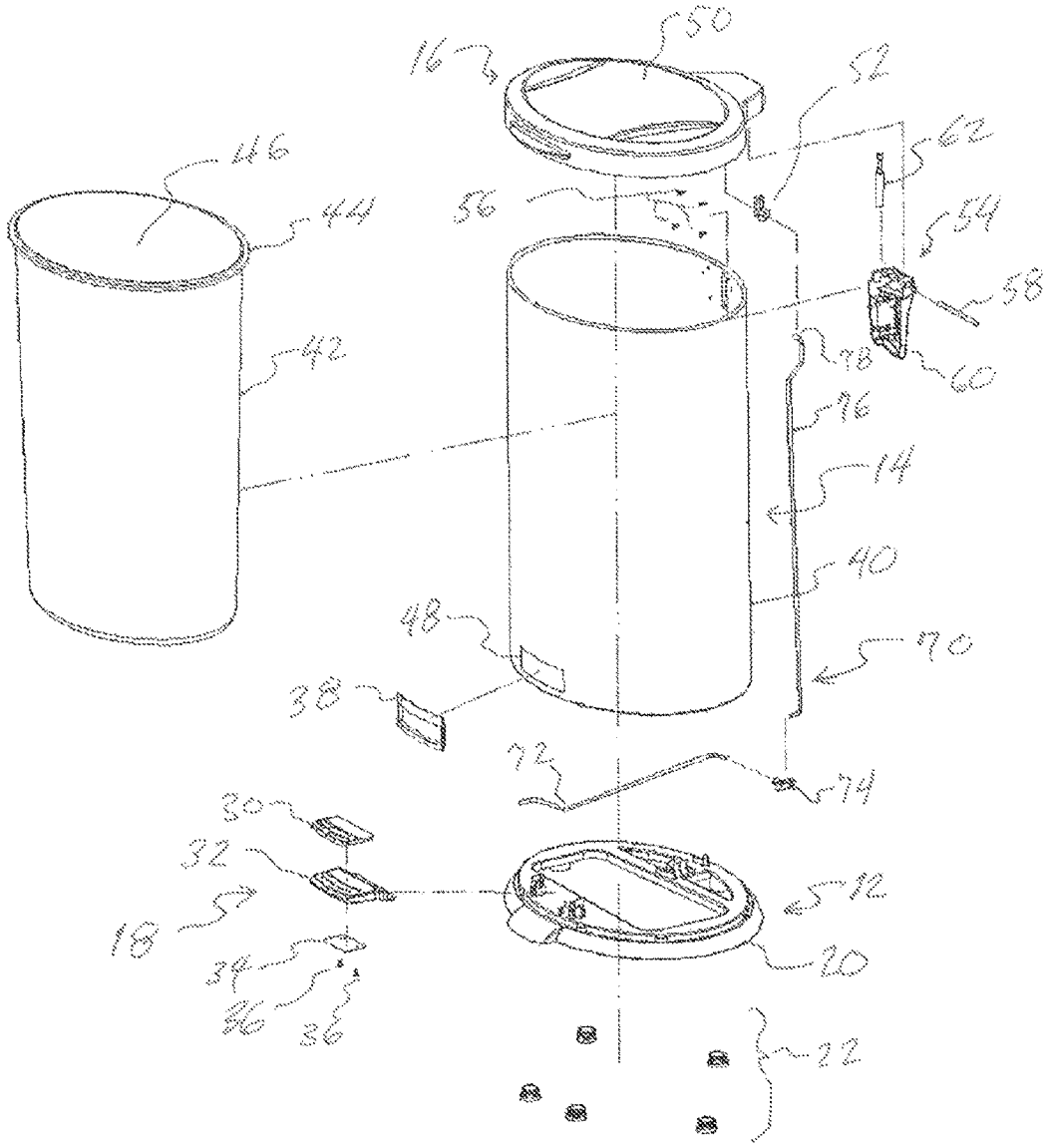
FIG. 2 is an exploded, perspective view of the trash bin of FIG. 1.

The various parts that collectively make up the pedal operated trash bin 10 are shown in FIG. 2. The base assembly 12 includes a base platform 20 and, preferably, resilient feet 22. Such feet enable the trash bin to be moved across a hard floor surface such as wood or tile without scuffing or scratching the floor and may resist inadvertent lateral movement of the trash bin.

The pedal assembly 18 comprises a decorative plate 30, a pedal member 32, a retaining plate 34, and fasteners 36. The fasteners, which may be provided as threaded members such as screws, pass through the retaining plate from below and project up through the lower surface of the pedal member and into the underside of the decorative plate, thereby holding the pedal assembly together. The decorative plate in one embodiment is fabricated of metal in order to provide a higher degree of wear resistance. Fabrication of the decorative plate is preferably via injection molding.

The side wall portion 14 comprises an outer side wall enclosure 40, a liner 42, and a pedal frame 38. The side wall portion may be provided of metal such as stainless steel for ease of cleaning, for strength, and for a pleasant appearance. The liner is preferable provided in plastic such as polyethylene for ease of cleaning, for weight reduction, and for providing a somewhat resilient material. An outwardly projecting flange portion 44 at an upper extent of the liner defines an opening 46 into the interior of the liner. The lower surface of the flange is dimensioned to rest on the upper peripheral edge of the enclosure such that the liner is suspended within the enclosure. The pedal frame 38 is preferably made from metal to inhibit wear from pedal movement therein and for providing a pleasant appearance. The pedal frame may be provided with resilient members (not shown) for enabling the pedal frame to be inserted into and retained within a respective aperture 48 on the lower end of the outer side wall enclosure.

The lid assembly 16 is comprised of a lid portion 50, at least one S clip 52, and a hinge assembly 54. As will be discussed further, the S clip is configured for interference fit with a receiving member on the underside of the lid portion.

A hinge assembly 54 is comprised of a hinge body 60 attached to an upper end of the outer side wall enclosure 40, on a rearwardly facing surface thereof, via fasteners 56 such as threaded members such as screws. The hinge body is also attached to a lower surface of the lid portion 50, at a rearwardly facing end, via a horizontal axle 58 passing through the hinge body, as will be discussed in further detail below. The hinge assembly further comprises a buffer or piston 62 that enables gradual lowering of the lid assembly onto the upper extent of the side wall portion, thereby avoiding a loud noise as the lid assembly closes.

Also shown in FIG. 2 is an actuating assembly 70 that enables the opening and closing of the lid portion 50 via actuation of the pedal assembly 18. The actuating assembly comprises a Z wire 72, a wire hook 74, and a shaft 76. Preferably, at least the Z wire and shaft are metal for strength and resistance to deformation.

Figure 3A:
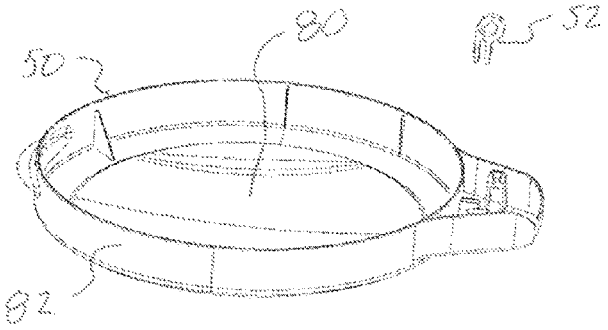
FIGS. 3A-3D are perspective views of an underside of trash bin lid in an inverted orientation and an S hook for mating therein, for use in the trash bin of FIG. 1.
Figure 3B:
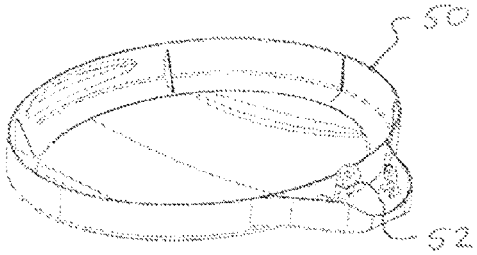

FIGS. 3A-3D illustrate the physical relationship between lid portion 50 and the S clip 52. In FIGS. 3A and 3B, the lid portion is shown in an inverted orientation such that the underside of the lid portion is facing up. The lid portion comprises a central cover 80 that may be planar or domed surrounded by a peripheral lip 82. The lip normally projects downward from the cover when the lid portion is in a closed configuration, such as seen in FIG. 1. The lip is preferably dimensioned to fit on and about the flange portion 44 of the liner 42 in order to inhibit the escape of odors associated with waste disposed within the trash bin 10.

Figure 3C:
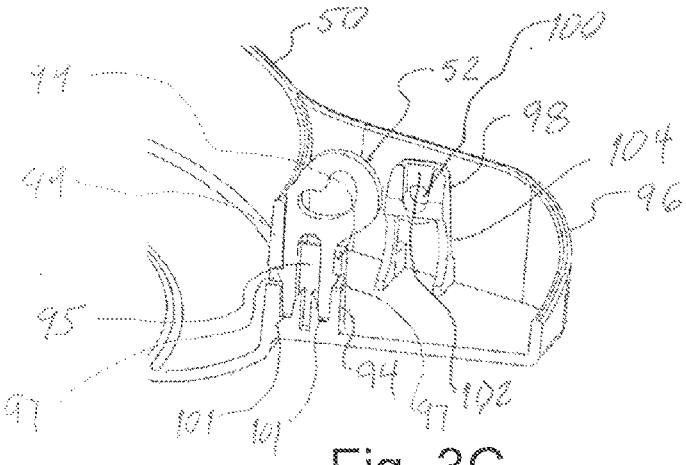
Figure 3D:
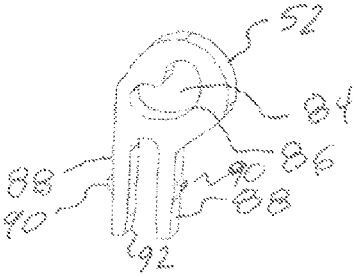

The S clip, best seen in FIG. 3D, has an aperture 84 with an arcuate control surface 86. An upper end 78 of the shaft 76 is normally disposed within the aperture. As the shaft is moved upwards by operation of the pedal assembly, the upper end travels along the control surface as the lid assembly swings towards an open configuration about the axle 58. The S clip is also provided with two opposing legs 88, each having a respective barb 90 formed thereon. Each barb has a substantially horizontal upper surface and an inclined side surface extending from the upper surface to the respective leg outer surface. A region of reduced thickness 92 may be provided at a distal end of each leg to facilitate installation of the S clip within a receiving slot 94, shown in section in FIG. 3C. The receiving slot is integrally formed on a readwardly facing hinge cover 96 of the lid assembly 16 and comprises two mutually parallel vertical side walls 95 (only one of which is shown in FIG. 3C) for laterally supporting an S clip installed within the slot. The slot and legs are preferably sufficiently long such that the S clip, when disposed within the slot, resists lateral movement when under force of the actuating assembly 70. Each barb projects outwardly from the respective leg and into a respective aperture 97 in one of two mutually parallel slot end walls 99, thus enabling the S clip to resist being inadvertently removed from the slot. The S clip is preferably formed of plastic whereby the legs are capable of deformation towards each other as the S clip is inserted into the slot and as the barbs interact with the inside surface of the end walls. Once the barbs are inserted far enough into the slot, each projects into the respective aperture as the legs resume a neutral shape. Simultaneously, the region of reduced thickness of each leg may be entrained within a respective receptacle 101 at the base of the slot. The receptacles serve to maintain the S clip legs in a substantially vertical orientation once fully installed into the slot, thereby resisting deformation that would otherwise facilitate removal of the barbs from the respective apertures.

Also disposed on the underside of the hinge cover 96 are axle mounts 98, one of which is visible in FIG. 3C. Each axle mount includes a laterally oriented aperture 100, and an inclined surface 102 proximate the aperture. The mount is shown disposed on the hinge cover via two legs 104, though a variety of configurations for the mount attachment are contemplated. The aperture has a diameter that is slightly greater than that of the axle 58. The lid assembly 16 is installed on the hinge assembly 54 by forcing the axle end to travel against the inclined surface, thereby causing the inclined surface to deform outward until the axle end is received within the aperture, at which point the mount returns to its rest position, entraining the axle therein. Preferably, the lid assembly is installed on the hinge assembly via a robotic manipulator (not shown).

Figure 4A:
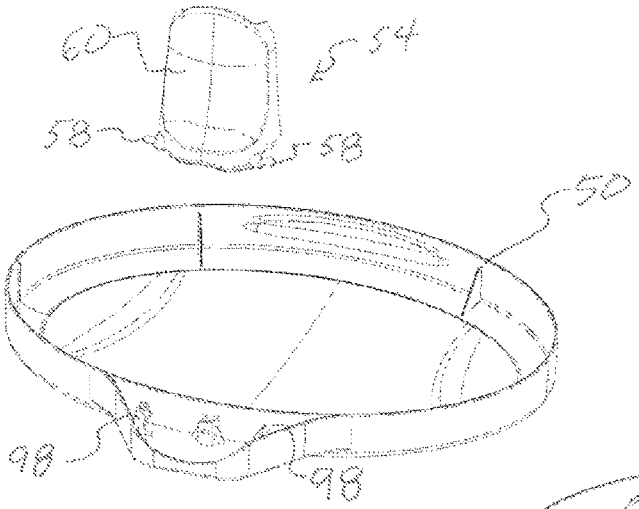
FIGS. 4A-4C are perspective views of the underside of the trash bin lid of FIGS. 4A-4D along with a hinge assembly for mating therein.
Figure 4B:
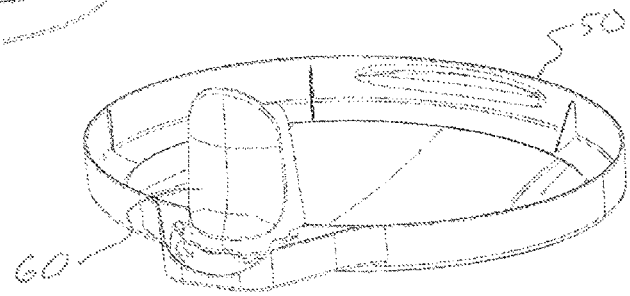
Figure 4C:
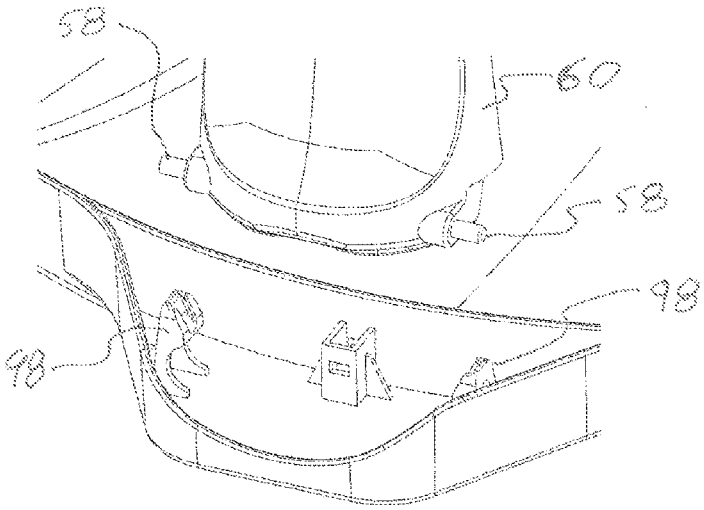

In FIG. 4A, the hinge assembly 54, including the axle 58, is illustrated in over the mounts 98 on the inverted lid portion 50. In one embodiment, the axle is iron and is insert or injection molded in the hinge body at the time the hinge body is formed. In FIG. 4B, the hinge body 60 of the hinge assembly is shown in an installed position on the lid portion in which the axle ends have been entrained within the respective mount. In FIG. 4C, the hinge body and axle is vertically aligned for installation into the mounts.

Figure 5A:
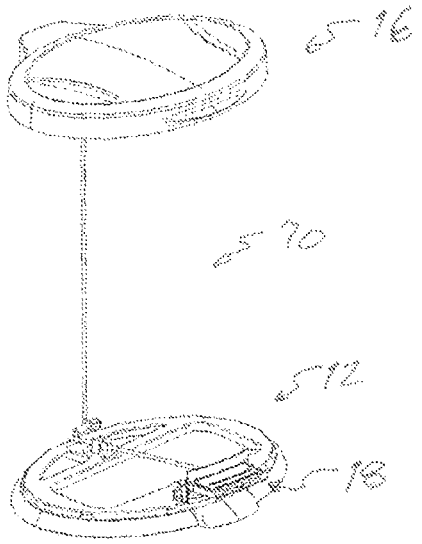
FIG. 5A is a perspective view of a base assembly, lid assembly, and actuating assembly of the trash bin of FIG. 1.
Figure 5B:
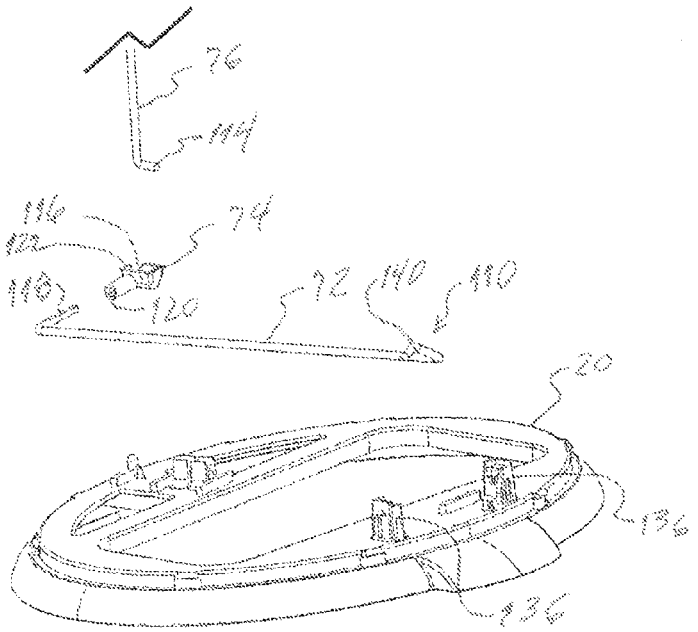
FIG. 5B is an exploded perspective view of the base assembly and elements of the actuating assembly of FIG. 5A.

In FIGS. 5A and 5B, the lid assembly 16, actuating assembly 70, base assembly 12, and pedal assembly 18 are shown in an assembled configuration. Essentially, the view of FIG. 5A includes all components of the presently disclosed trash bin except the side wall portion 14. In FIG. 5B, the base platform 20 is shown proximate the Z wire 72, wire hook 74 and a lower end 114 of the shaft 76. The lower end of the shaft is substantially orthogonal to the vertical main portion of the shaft and is configured to be received within a socket 122 at one end of the wire hook. As the wire hook is raised and lowered in response to actuation of the pedal assembly, an outer surface of the lower end of the shaft is simultaneously raised and lowered and is free to rotate relative to the socket. A notch 116 is formed in the socket wall to prevent the shaft from interfering with the socket wall as it rotates about the shaft lower end. At the other end of the wire hook, a wire hook sleeve 120 is provided for receiving a first end 118 of the Z wire. Preferably, both the wire hook sleeve and the first end of the Z wire have complimentary cross-sections and are fixed together in order to inhibit relative motion therebetween. Such fixation may be friction fit.

Figure 6A:
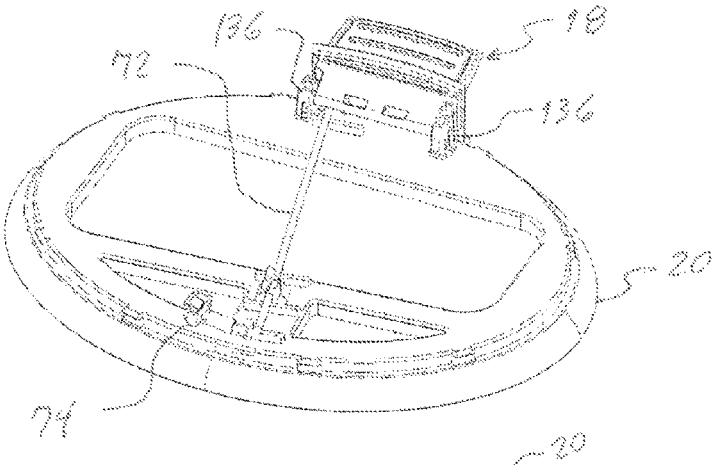
FIG. 6A is a perspective view of the base assembly of FIG. 5A with a Z wire of the actuating assembly installed therein.
Figure 6B:
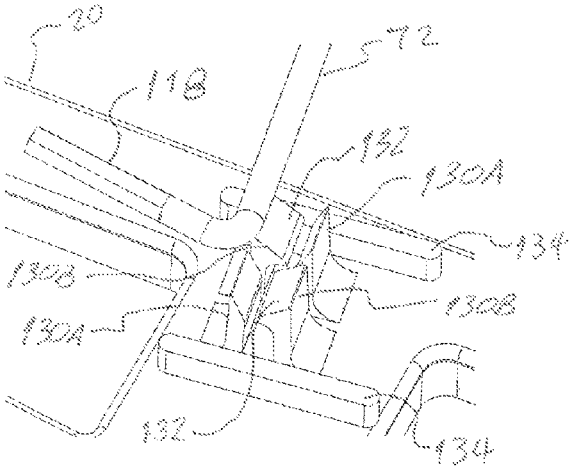
FIG. 6B is a perspective detail view of a retaining feature associated with the base assembly of FIG. 6A and one end of the Z wire thereabove.

In FIG. 6A, the Z wire 72 and wire hook 74 are shown in an installed configuration with respect to the base platform 20 and the pedal assembly 18. In FIG. 6B, the first end 118 of the Z wire is shown proximate retaining tabs 130A, 130B formed on the base platform. The retaining tabs are flexible and are capable of being laterally deflected in order to receive the Z wire therebetween. While in one embodiment the retaining tabs are identical, the illustrated pairs of dissimilar tabs is preferred. Specifically, one retaining tab 130A of each pair is essentially a vertical post, while the other retaining tab 130B of each pair is a vertical post having a horizontally projecting member 132 that projects towards the opposite retaining member. The latter retaining tab is essentially L-shaped when viewed from the side. Thus, the installed Z wire is retained between the two retaining tabs 130A, 130B of each pair and underneath the projecting member 132 of one retaining tab 130B of each pair.

Figure 6C:
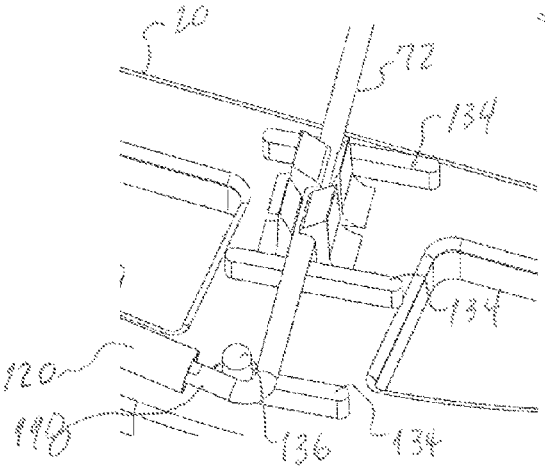
FIG. 6C is a perspective detail view of the retaining feature of FIG. 6B with the Z wire entrained therein.

There are two pairs of retaining tabs 130A, 130B on the base platform 20, aligned such that the Z wire 72 passes through both, as shown in FIGS. 6B and 6C. Importantly, the retaining tab 130B having the projecting member 132 of one pair is on the opposite side of the installed Z wire from the retaining tab having the projecting member of the other pair. With this configuration, there is a reduced likelihood that the Z wire may be inadvertently freed from the grip of the retaining tabs as compared to a configuration in which the retaining tabs having the projecting member are on the same side of the Z wire.

Also shown in FIG. 6B are bearing surfaces 134 on either side of the pairs of retaining tabs 130A, 130B. The Z wire 72, when disposed within the retaining tabs, rests on the upper surface of the bearing surfaces and is free to rotate thereon. An additional bearing surface 134 is visible in FIG. 6C, proximate the first end 118 of the Z wire. Also proximate the first end of the Z wire and projecting up from the base platform 20 is a vertical post 136 that serves to inhibit lateral movement of the respective end of the Z wire.

Figure 7A:
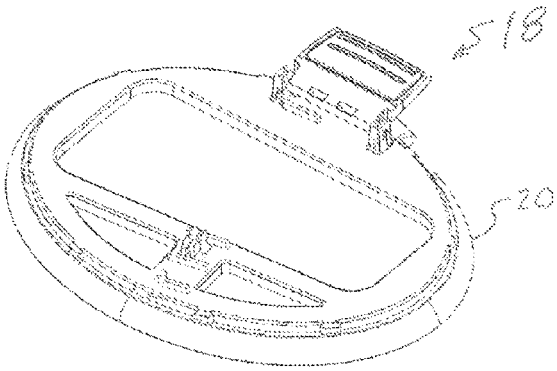
FIG. 7A is a perspective view of the base assembly of FIG. 5A with a pedal assembly installed thereon.
Figure 7B:
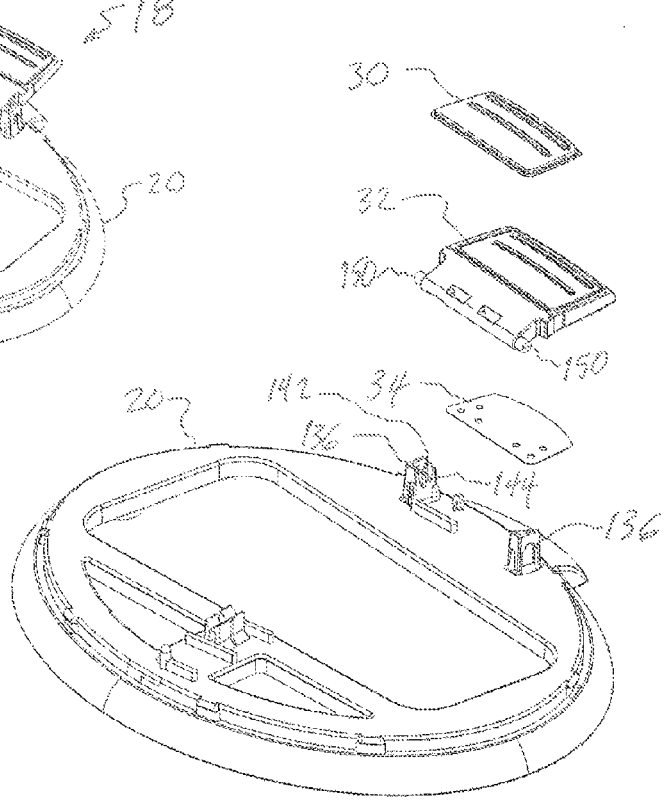
FIG. 7B is a perspective view of the base assembly of FIG. 7A with an exploded view of the pedal assembly.
Figure 7C:
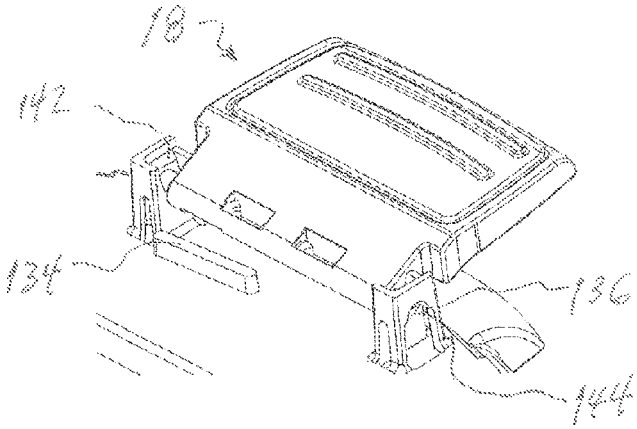
FIG. 7C is a perspective detail view of the pedal assembly of FIGS. 7A and 7B.

With regard to FIGS. 7B and 7C, the pedal assembly 18 is configured to selectively rotate about a lateral axle 150 when mounted on the base platform 20 via pedal axle receiving posts 136. These posts are similar to the axle mounts 98 employed to join the lid assembly 16 with the hinge assembly 54. Specifically, each post preferably includes an inclined surface 142 proximate a laterally oriented aperture 144 configured to receive the axle associated with the pedal assembly. The inclined surface of each post deflects outwardly as a horizontal axle end is moved vertically with respect to the post until the end is aligned with the respective aperture, at which point the post resumes its neutral shape and the axle end is entrained within the respective aperture.

The second end 110 of the Z wire 72 is orthogonal to the central portion of the Z wire and angled slightly out of the plane defined by the Z wire first end 118 and the Z wire central portion, as shown in FIG. 5B. A distal portion of the Z wire second end is angled back towards the plane defined by the Z wire first end and the Z wire central portion, thereby forming an upwardly projecting knuckle 140. The knuckle rests against a lower surface of the pedal retaining plate 34. When the lid assembly 16 is in a closed configuration, the upper end 78 of the shaft 76 is in a lowered position within the S hook 52. This also means the second end 114 of the shaft rests within the wire hook 74. The second end 110 of the Z wire is then in an elevated position with the knuckle 140 adjacent and preferably in contact with the retaining plate. The pedal assembly 18 is substantially horizontal.

FIG. 7A illustrates a pedal assembly 18 installed on the base platform 20. In FIG. 7B, the major components of the pedal assembly include the decorative plate 30, pedal member 32, and retaining plate 34, all of which are joined together through the use of fasteners such as screws 36 (FIG. 2). The receiving posts 136 are also shown, including inclined surfaces 142 and receiving apertures 144. FIG. 7C provides a close-up view of the installed pedal assembly. Also visible is another bearing surface that supports the Z wire 72 from beneath.

In operation, when a user presses down on the pedal assembly 18 with their foot, the pedal assembly rotates downward about the respective horizontal axle. This pushes down on the knuckle 140 on the second end 110 of the Z wire. As a result, the central portion of the Z wire rotates about its axis, within the retaining tabs 130A, 130B and on the bearing surfaces 134. Rotation of the Z wire causes the first end 118 to rise, which causes the wire hook 74 to rise. This elevates the shaft 76, which pushes up on the lid assembly via the S hook 52 as the shaft first end 78 travels along the arcuate control surface of the S hook. As the lid assembly opens via rotation about the horizontal hinge assembly axle 58, the piston 62 extends in the absence of downward pressure applied by the weight of the lid assembly. When the user removes downward pressure from the pedal assembly, the weight of the lid assembly bears on the piston, which gradually compresses, and the lid assembly gradually closes. The upper end 78 of the shaft 76 travels down the control surface of the S hook. The wire hook is urged downward by the lowering shaft, thereby rotating the Z wire such that the knuckle 140 is elevated and the pedal assembly is again urged into a horizontal orientation.

Preferably, the majority, if not all, of the components of the presently disclosed invention are assembled through automatic assembly processes, such as through the use of robots along a conveyorized assembly line. The S hook 52 is configured for vertical installation into the inverted lid portion 50 and for retention therein without the use of discrete fasteners; direct vertical movement is easily accomplished by robotic assembly mechanisms. Similarly, the hinge assembly 60 is easily inserted into the lid portion 50 through downward vertical pressure, and retention is accomplished as the result of momentary deformation and relaxation of axle mounts 98. Installation of the hinge assembly onto the side wall portion 14 is via a plurality of fasteners, such as screws 56.

In a similar manner, the actuating assembly 70 is provided in materials and in physical shapes that facilitate simple, automated assembly. The upper end 78 of the shaft 76 is disposed within the S hook 52 through a simple lateral movement. The opposite, lower end 114 of the shaft is simply vertically inserted into the wire hook 74 socket 122.

The Z wire first end 118 fits into the wire hook sleeve 120 through friction fit, without the use of discrete fasteners, thus simplifying assembly.

As described above, the Z wire 72 is installed on the base platform 20 by downward pressure against retaining tabs 130A and 130B. At least one tab of each pair deforms under the pressure applied by the Z wire, then relaxes, thereby retaining the Z wire between the pairs of retaining tabs and on bearing surfaces 134.

The components of the pedal assembly 18 are mutually joined together through the use of fasteners such as screws 36 prior to installation of the assembly into the pedal axle receiving posts 136 on the base platform 20 in a manner similar to installation of the hinge assembly 54 into the lid portion 20, as described above. That is, the receiving posts are deformed outward as the pedal assembly axle 150 is pressed downward by robotic means.

In one embodiment, assembly of the presently disclosed trash bin includes robotic pre-assembly of the pedal assembly through joining the decorative plate 30, pedal member 32, and retaining plate 34 using threaded fasteners 36. Resilient feet are installed onto an underside of the base platform 20.

Other automated devices insert the first end of the Z wire 118 into the wire hook sleeve 120, then drive that assembly down between the pairs of retaining tabs 130A, 130B and onto the bearing surfaces 134 on the base platform 20. The pedal assembly 18 is then driven down onto the vertical posts 136 projecting upwards from the base platform through the use of a robotic manipulator, the ends of the pedal assembly axle 150 coming into contact with the inclined surfaces 142 and causing them to deflect outward under the downward force. Eventually, the ends are received within the apertures 144 and the posts resume a neutral stance.

In an exemplary embodiment, the lid portion 50, including the hinge cover 96, is inverted so that the axle mounts 98 and the receiving slot 94 are directed upwards. This enables an automated manipulator to grasp an S clip 52 and direct the distal ends 92 of the two legs vertically, down into the receiving slot. The barbs 90 interact with the interior surface of the two end walls 99 and cause the legs to deform inwardly. Further forcing the reduced thickness distal ends into respective receptacles 101 brings the barbs into alignment with respective side wall apertures 97. The substantially horizontal upper surface and the inclined side surfaces of the barbs then project outwardly into the apertures and the S clip legs relax into a substantially vertical neutral position, with the S clip firmly entrained within the receiving slot.

The hinge body 60 with piston 62 and substantially horizontal axle 58 is then forced down onto the axle mounts 98, in a fashion similar to that of the pedal assembly axle 150, whereby the axle ends come into contact with inclined surfaces and deflect the axle mounts outward until the axle ends are received within the respective apertures. The lid assembly with hinge body may then be inverted and attached to the side wall portion 40 via fasteners 56.

The shaft 76 first end 114 is disposed within the wire hook socket 122 via a robotic actuator. The pedal frame 38 is pressed onto the outer side wall enclosure 40, and the side wall portion 14 is lowered over the pedal assembly 18 so that the latter projects through the frame, with the shaft projecting upwards within the enclosure. The enclosure is then mated with the base platform 20, such as through mechanically interfering clips or other mechanical means. The shaft second end 78 is disposed within the S clip opening, proximate the arcuate control surface 86. The liner 42 is installed into the enclosure. Assembly is complete.

Many changes in the details, materials, and arrangement of parts and steps, herein described and illustrated, can be made by those skilled in the art in light of teachings contained hereinabove. Accordingly, it will be understood that the following claims are not to be limited to the embodiments disclosed herein and can include practices other than those specifically described, and are to be interpreted as broadly as allowed under the law.

What is claimed is:

1. A trash bin optimized for automated assembly, comprising:

a base platform comprising two adjacent pairs of retaining tabs on an upper surface thereof, each pair of retaining tabs comprising a first vertical post tab and a second vertical post tab having a substantially horizontally projecting member that projects towards the first vertical post tab, wherein the first tab of a first pair is adjacent the second tab of a second pair and the second tab of the first pair is adjacent the first tab of the second pair, and a pair of receiving posts projecting upwardly from the base platform and each having an inclined face and an aperture proximate the inclined face, wherein the inclined faces of the two receiving posts are substantially mutually parallel and the two apertures are mutually parallel and aligned;

an actuating assembly comprising a wire hook, a Z wire having a middle portion with an axis of rotation, and a shaft, the wire hook having a socket at one end for receiving a lower end of the shaft and a wire hook sleeve for receiving a first end of the Z wire, the two adjacent pairs of retaining tabs for receiving the Z wire middle portion within each;

a lid portion having a central cover, a peripheral lip about the central cover, and a hinge cover projecting rearwardly from the central cover, the hinge cover comprising an S clip having an internal arcuate control surface, two parallel legs, and a barb projecting from each leg on an outer surface thereof, a substantially vertical receiving slot comprised of two mutually parallel side walls, two mutually parallel end walls, and an aperture in each end wall, the receiving slot dimensioned to receive the S clip legs between the side walls and end walls and the barb of each leg within a respective one of the apertures, and a pair of axle mounts, each comprised of plural legs in mechanical communication with the hinge cover, an inclined face connected to the plural legs, and a horizontally disposed aperture proximate the inclined face, whereby the apertures of the pair of axle mounts are mutually parallel and aligned;

a side wall portion comprised of an outer side wall enclosure having open upper peripheral end, an open lower end and a pedal assembly aperture proximate the lower end thereof, the side wall portion lower end being adapted for mechanically mating onto the base platform;

a hinge assembly comprised of a hinge body, a horizontal axle disposed through the hinge body, and fasteners for mechanically attaching the hinge body to an outer surface of the side wall portion proximate the outer side wall enclosure upper end, the horizontal axle adapted for being pressed across the inclined faces of the pair of axle mounts of the lid portion until being received within the apertures of the pair of axle mounts; and a pedal assembly comprising a substantially horizontal axle adapted for being pressed across the inclined faces of the pair of receiving posts on the base platform until being received within the apertures of the pair of receiving posts, wherein a second end of the Z wire comprises a knuckle portion disposed in communication with a lower surface of the pedal assembly, wherein an upper end of the shaft is adapted to be inserted into the S clip adjacent the internal arcuate control surface, whereby application of downward force on the pedal assembly about the pedal assembly horizontal axle forces the knuckle portion to move in a downward direction, rotating the Z wire middle portion about the axis of rotation and raising the wire hook socket and the shaft first end received therein, raising the shaft second end within the S clip and along the internal arcuate control surface, and forcing the lid portion to rotate upward about the hinge assembly horizontal axle, and whereby removal of the downward force on the pedal assembly allows the weight of the lid portion and the S clip connected thereto to push the shaft second end downward, pushing the shaft first end and the wire hook socket receiving it downward, rotating the Z wire about the axis or rotation, moving the knuckle portion upward, and forcing the pedal assembly upward.

2. The trash bin of claim 1, wherein the base platform further comprises substantially horizontal bearing surfaces adapted to receive a portion of the Z wire middle portion thereon for enabling the Z wire to rotate about the Z wire axis of rotation while preventing the Z wire from moving in a downward vertical direction.

3. The trash bin of claim 1, wherein the Z wire first end is substantially orthogonal to the Z wire axis of rotation.

4. The trash bin of claim 3, wherein the Z wire second end, in a vertical projection, is orthogonal to the Z wire axis of rotation and, in a horizontal projection, extends out of the plane formed by the Z wire first end and the Z wire middle portion.

5. The trash bin of claim 1, wherein the side wall portion further comprises a liner having an closed lower end and an open upper end having an outwardly projecting flange portion thereabout, the liner dimensioned for being disposed within the outer side wall portion with the flange portion of the liner resting on the open upper peripheral end of the side wall portion.

6. The trash bin of claim 1, wherein each barb has a substantially horizontal upper surface and an inclined side surface extending from the upper surface to an outer surface of the respective leg.

7. The trash bin of claim 1, wherein each leg of the S clip comprises a region of reduced thickness at a distal end thereof and wherein the substantially vertical receiving slot further comprises a pair of receptacles at a lower end thereof, each for receiving a respective leg region of reduced thickness.

8. The trash bin of claim 1, wherein the pedal assembly further comprises a pedal member having the substantially horizontal pedal assembly axle extending therethrough, a decorative plate disposed on the pedal member, a retaining plate disposed under the pedal member, and fasteners for joining the decorative plate, the pedal member and the retaining plate, wherein the retaining plate is adapted to mechanically interface with the Z wire second end disposed therebeneath.

9. The trash bin of claim 1, wherein the hinge assembly further comprises a piston in mechanical communication with the hinge body and adapted to mechanically interfere with an underside of the lid portion hinge cover, the piston adapted to mechanically resist downward movement of the lid portion.

10. A method of assembling a trash bin, comprising:

assembling a pedal assembly by joining a decorative plate, a pedal member and a retaining plate with fasteners;

inserting a first end of a Z wire into a sleeve of a wire hook;

inserting a middle portion of the Z wire into two adjacent pairs of retaining tabs on an upper surface of a base platform, each pair of retaining tabs comprising a first vertical post tab and a second vertical post tab having a substantially horizontally projecting member that projects towards the first vertical post tab, wherein the first tab of a first pair is adjacent the second tab of a second pair and the second tab of the first pair is adjacent the first tab of the second pair, disposing a second end of the Z wire having an upwardly projecting knuckle portion between a pair of receiving posts projecting upwardly from the base platform;

inserting a pedal axle having ends projecting laterally from the pedal assembly onto the pair of receiving posts, each post having an inclined face and an aperture proximate the inclined face, wherein the inclined faces of the receiving posts are substantially mutually parallel and the two apertures are mutually parallel and aligned, wherein insertion of the pedal axle onto the receiving posts causes the axle ends to deflect the inclined faces outwardly until the axle ends are received within the apertures;

inserting an S clip having an enclosed arcuate control surface therein and two parallel legs, each with an outwardly projecting barb, into a receiving slot formed on an underside of a hinge cover of a lid assembly, the receiving slot having two mutually parallel side walls and two mutually parallel end walls, the end walls each having an aperture therein for receiving a respective barb, wherein insertion of the S clip into the receiving slot causes the S clip legs to deflect inwardly as the barbs pass along an interior surface of the end walls until the barbs enter the respective apertures;

inserting a hinge axle having ends projecting laterally from a hinge body onto a pair of axle mounts formed on the underside of the hinge cover, each post having an inclined face and an aperture proximate the inclined face, wherein the inclined faces of the axle mounts are substantially mutually parallel and the two apertures are mutually parallel and aligned, wherein insertion of the hinge axle onto the receiving posts causes the axle ends to deflect the inclined faces outwardly until the axle ends are received within the apertures;

mounting the hinge body to a side wall portion proximate a side wall portion open upper end whereby the hinge cover and a lid portion affixed thereto are selectively locatable on the side wall portion open upper end;

inserting a first end of a shaft into a socket of the wire hook;

disposing a pedal aperture, formed on a side wall portion open lower end, over the pedal assembly on the base platform and mounting the side wall portion open lower end onto the base platform;

inserting a second end of the shaft into the S clip, proximate the enclosed arcuate control surface; and installing a liner having a closed lower end and an open upper end into the side wall portion.

11. The method of claim 10, further comprising disposing a piston between the hinge cover and the hinge body, the piston for resisting downward movement of the hinge cover.

12. The method of claim 10, wherein the step of inserting a middle portion of the Z wire into two adjacent pairs of retaining tabs on an upper surface of a base platform further comprises inserting the middle portion of the Z wire onto at least one bearing surface projecting upwardly from the base platform.

13. The method of claim 10, further comprising installing a pedal frame into the pedal aperture prior to disposing the pedal aperture over the pedal assembly.

* * * * *